US009222325B2

(12) United States Patent
Early et al.

(10) Patent No.: US 9,222,325 B2
(45) Date of Patent: Dec. 29, 2015

(54) MARINE RISER ISOLATION TOOL

(75) Inventors: Ciaran Early, Dublin (IE); Gary Murray, Dublin (EA); Raymond Honour, Kent (GB)

(73) Assignee: THE SAFER PLUG COMPANY LIMITED, Grand Cayman (KY)

( * ) Notice: Subject to any disclaimer, the term of this patent is extended or adjusted under 35 U.S.C. 154(b) by 54 days.

(21) Appl. No.: 14/008,052

(22) PCT Filed: Mar. 31, 2011

(86) PCT No.: PCT/EP2011/055033

§ 371 (c)(1),
(2), (4) Date: Sep. 27, 2013

(87) PCT Pub. No.: WO2012/130315

PCT Pub. Date: Oct. 4, 2012

(65) Prior Publication Data

US 2014/0014355 A1 Jan. 16, 2014

(51) Int. Cl.
*E21B 33/12* (2006.01)
*E21B 33/035* (2006.01)
*E21B 43/01* (2006.01)

(52) U.S. Cl.
CPC ..... *E21B 33/035* (2013.01); *E21B 43/0122* (2013.01)

(58) Field of Classification Search
CPC ..... E21B 43/01
USPC ..... 166/363
See application file for complete search history.

(56) References Cited

U.S. PATENT DOCUMENTS

| | | | | |
|---|---|---|---|---|
| 4,314,615 | A | 2/1982 | Sodder et al. | |
| 7,055,625 | B1 * | 6/2006 | Myrick et al. | 175/26 |
| 2005/0028980 | A1 | 2/2005 | Page et al. | |

FOREIGN PATENT DOCUMENTS

| | | | |
|---|---|---|---|
| DE | 202010009171 | | 12/2010 |
| DE | 202010009171 | U1 * | 12/2010 |
| GB | 2410756 | | 8/2005 |

OTHER PUBLICATIONS

International Search Report dated Nov. 29, 2011.

*Primary Examiner* — Matthew Buck
*Assistant Examiner* — Patrick Lambe
(74) *Attorney, Agent, or Firm* — Hoffmann & Baron, LLP

(57) ABSTRACT

The present invention relates to a marine riser isolation tool in particular to an autonomous marine riser isolation tool having a robotic plug installation device that is adapted for positioning a pipeline isolation plug in a vertical pipe such as a marine riser, resulting in sealing of the marine riser.

In one aspect of the invention, there is provided an autonomous plug installation device that is suitable for installing an isolation tool in a marine riser, the plug installation device comprising;

a hydraulic ram system comprising a plurality of pipe engaging means positioned along an exterior surface of the hydraulic ram system, the pipe engaging means being operable by the hydraulic ram system to be movable between a retracted and extended configuration such that the pipe engaging means are engagable with the interior surface of the marine riser;

a control system in communication with the hydraulic ram system to control the movement of the pipe engaging means such that the robotic unit locates the pipe isolation tool at a predetermined location in the vertical pipe; and an autonomous ELF communications system. A method of sealing a leaking marine riser using the marine riser isolation tool is also disclosed.

16 Claims, 10 Drawing Sheets

MARINE RISER ISOLATION TOOL

This application is the U.S. National Phase of, and Applicants claim priority from, International Patent Application Number PCT/EP2011/055033 filed 31 Mar. 2011, which is incorporated herein by reference.

The present invention relates to a marine riser isolation tool in particular to an autonomous marine riser isolation tool having a robotic unit that is suitable for positioning a pipeline isolation plug in a vertical pipe such as a marine riser, resulting in sealing of the marine riser.

Underwater Drilling Operations rely on Blow Out Preventers (BOPs). BOPs are safety barriers which isolate the drilling operation from uncontrolled reservoir activity e.g. loss of containment from the well or catastrophic failure of the marine riser. BOPs are positioned on the seabed, on top of the well head casing.

The marine riser is the sleeve which guides the drill string from the drilling rig or drill-ship, through the BOP, and into the casing installed in the seabed and down into the well. The drilling fluids are pumped down inside the drill string, to the drill bit. The drilling fluids return back to the vessel, by being pressurised up the outside of the drill string, within the annulus between the drill string and the casing, through the BOP and up inside the marine riser back to the drilling rig. Marine risers come in specific ID sizes, wall thicknesses and pipe strengths. All casing and marine riser sizes are listed in the standard API 5CT.

A particular danger associated with drilling operations and deep sea wells is a 'loss of well control' event. Often any escaping fluids (liquids or gases) caused by such a loss of well control event, causes significant human, ecological and environmental damage. An example of such a disaster is the Deepwater Horizon, a floating semi submersible oil rig in the Gulf of Mexico, where a loss of well control event caused a catastrophic human and environmental disaster. The BOP safety barrier failed and the hydrocarbon gas which escaped from the well's reservoir, travelled upwards through the marine riser into the drilling rig where it ignited, causing an explosion and fire which engulfed the drilling rig, killing eleven workers and injuring many others. After burning for 36 hours, the Deepwater Horizon drilling rig sank. Concurrently after the explosion, the well began to leak oil into the Gulf of Mexico.

Prior to the explosion, final preparations were being made to temporarily abandon the Deepwater Horizon's Moncando well. The loss of containment event, breached the BOP and a large number of additional safety measures that normally operate in the event of BOP failure did not function. Consequently, hydrocarbons continued to flow from the wells reservoir, through the BOP and into the buckled marine riser. The logistics of providing a solution to contain or control a leaking marine riser are onerous and accordingly take considerable time to plan, make ready and put in place.

The flow from the well was temporarily stayed within approximately 11 weeks, before a flange transition spool and a three ram stack device known as 'Top Hat No 10' were installed. At this point, the well had already leaked 4.9 million barrels (185 million gallons) of oil into the Gulf of Mexico. A "Top Hat" is a large structure which requires a large installation vessel together with a heavy crane vessel fitted with deep wire to install the device. An active methanol injection system is also required to eliminate hydrates. Furthermore, a "Top Hat" solution also requires a dynamically positioned tanker to collect the leaking product. Thus in reality, "Top Hat" solutions are not viable solutions. Any partial solution which requires a collection tanker is only a temporary measure.

Finally, approximately 21 weeks after the initial explosion a relief well from an adjacent drill rig intercepted and sealed the well thereby fully stopping the flow of hydrocarbons from the well.

No other contingency solutions were ready and available to isolate the well.

The present invention seeks to alleviate the disadvantages of the prior art.

It is acknowledged that the term 'comprise' may, under varying jurisdictions be provided with either an exclusive or inclusive meaning. For the purpose of this specification, the term "comprise" shall have an inclusive meaning, i.e. that it should be taken to mean an inclusion of not only the listed components it directly references, but also other non-specified components. Accordingly, the term 'comprise' is to be attributed with as broad an interpretation as possible within any given jurisdiction and this rationale should also be used when the terms 'comprised' and/or 'comprising' are used.

According to a first aspect of the invention, there is provided an autonomous robotic unit that is suitable for locating a pipeline isolation tool in a marine riser, the robotic unit comprising:

- a hydraulic ram system comprising a plurality of pipeline engaging means positioned along an exterior surface of the hydraulic ram system, the pipeline engaging means being operable by the hydraulic ram system to be movable between a retracted and extended configuration such that the pipeline engaging means are engagable with the interior surface of the pipeline;
- a control system in communication with the hydraulic ram system to control the movement of the pipeline engaging means such that the robotic unit locates the pipeline isolation tool at a predetermined location in the vertical pipe; and a communications system.

The marine riser isolation tool of the present invention has the advantage that it provides a quick and easy solution to stop the flow of gas or hydrocarbons from a leaking marine riser where a BOP has failed.

The advantage of the marine riser isolation tool of this invention is that it comprises an autonomous robotic plug installation device which can be delivered into a leaking marine riser, and which will then hydraulically pull an isolation plug, down into the marine riser in order to seal the marine riser, thereby isolating the well. This will provide a permanent, leak tight, isolation solution for the leaking marine riser. The isolation plug is preferably a by passing isolation plug i.e. the plug includes at least one valve which is moveable between an open and closed position such that flow of upcoming fluid can pass through the at least one valve and hence through the isolation plug when the at least one valve is in the open position but when the valve is in the closed position, no fluid can pass through the isolation plug. The valves are controlled by the WROV (Work Class Remotely Operated Vehicle) which communicates with the plug using Extremely Low Frequency (ELF) communications. A signal is sent to the WROV from a controller which is prompted by an operator at a user interface. The WROV then passes the signal to the plug.

Use of the marine riser isolation tool of the present invention provides a technical solution which removes the requirement for a topside vessel or a collection tanker to stay in position on the sea surface. The marine riser isolation tool of the present invention is retractable and thus provides a fail safe solution.

In a preferred embodiment of the invention, the marine riser isolation tool comprises a plug installation device having a plurality of rams, preferably eight rams, axially mounted thereon and two further rams longitudinally mounted on the plug installation device. Preferably, the axially mounted rams are arranged in two clusters of four rams. Advantageously, the plug installation device is provided with six degrees of freedom namely, movement up, down, left, right, forwards and backwards. The marine riser tool of the invention comprises the plug installation device which, in use, is a hydraulically operated, "walking ram" device.

In a further aspect of the invention, the plug installation device is pre-installed on a guide means which is attached, at one end, to a buoyancy device and at the other end, to a securing means, preferably comprising a clamp in use, the clamp securely attaches the guide means to the marine riser. The buoyancy device provides a positive up-thrust of buoyancy and is held in position above the opening of the marine riser at a distance determined by the guide means. The advantage of this is that it allows the marine riser tool comprising the plug installation device and other elements of the marine riser isolation tool, to be positioned in the water, vertically above the top of the marine riser. Preferably, the guide means comprise subsea guide wires.

In a further aspect of the invention, the buoyancy device comprises a syntactic foam parachute. Syntactic foam is specialist foam which does not collapse under hyperbaric pressure and this foam or alternatively aluminium ceramic flotation seamless hollow spheres are commonly used in subsea applications. It is understood that the term, "parachute" is a recognized term in the offshore oil & gas industry for a buoyancy device. The term "parachute" is used in the context of the buoyancy device because the profile of such buoyancy devices resemble a parachute shape. In one embodiment of the invention, the syntactic foam parachute provides an up-thrust of one ton of positive buoyancy. It is also possible to use any other type of buoyancy device or guide wire guidance, known to a person skilled in the art.

In a further aspect of the invention, the securing means are provided with connection means to which the guide means are attached. An example of such connection means includes pad eyes or latching stab connectors mounted on the securing means. In one embodiment of the invention, the guide wires are connected to the pad eyes or latching stab connectors mounted on the securing means.

In a further aspect of the invention, the securing means provide an anchor point for the guide means around the opening of the marine riser. In one embodiment of the invention, the securing means are provided as a clamp. Optionally, the clamp is provided as a half shell hydraulically operated closing bracelet clamp. Conveniently, this allows the clamp to be hydraulically locked in place by activating the clamp's hydraulic cylinder when the clamp is located at the correct position on the marine riser.

Preferably, the securing means are provided with an internal gripping surface whereby the internal surface of the clamp adjacent the pipeline wall is provided with gripping means which are configured to grip into the marine riser wall and hold against the direction of upward pull of the guide means. Optionally the gripping means of the clamp are provided as serrations of the internal surface of the clamp. In a further embodiment, the securing device is provided with additional back up bolts which can be tensioned to guarantee the clamp will stay securely locked onto the marine riser. Ideally, the clamp is made from any suitable light material that provides a high strength to weight ratio such as titanium.

In a further aspect of the invention, the plug installation device is provided with integrated hydraulic wire pullers, which enable the plug installation device to be driven down the parallel guide wires in a controlled manner and also enable the marine riser tool to move into the open top of the marine riser pipe.

In a further aspect of the invention, the autonomous isolation plug is also pre-installed on the guide means which are attached to a buoyancy device at the upper end and attached by a securing device to the opening of the marine riser at the lower end.

In a further aspect of the invention, the hydraulically operated autonomous isolation plug has its own control system, and ELF communications and the isolation plug includes at least one bypass valve. In one aspect of the invention, the autonomous isolation plug is provided with integrated hydraulic wire pullers which enable the autonomous isolation plug to be self driven from the buoyancy device down the guide wires. In a further aspect of the invention, the autonomous isolation plug is provided with complimentary coupling means which allows the autonomous isolation plug to couple to the plug installation device of the invention.

Briefly, the marine riser isolation tool of the invention operates as follows; the guide means comprising the subsea guide wires are secured to the marine riser using the securing device. The autonomous plug installation device which has been pre-installed onto the mounted guide wires propels its way down inside the marine riser through which fluid (i.e. gas or liquid) is flowing upwardly using a combination of its own integral hydraulic wire pushing hydraulic rams, and its axially located hydraulic feet rams. Once the plug installation device is the correct distance inside the marine riser, it can extend its telescopic pull in ram, in readiness to capture the autonomous isolation plug when it arrives. The autonomous isolation plug is driven down the guide wires and latched to the plug installation device and is pulled and driven downwards into the marine riser. Once the isolation plug is drawn the correct distance into the marine riser, the isolation plug is set and shut in, thereby stopping the flow of hydrocarbons from the leaking marine riser.

In a further aspect of the invention, the invention further comprises a Dead Man Anchor (DMA) assembly comprising the equipment touching or connected to the DMA such as the plug installation device, the guide wires, the syntactic foam parachute, the guide wire baskets, the isolation plug and the winch, where a Dead Man Anchor (DMA) is to be understood to describe a weighted anchor which transports the other equipment on the DMA assembly to depth, and which provides anchorage and leverage points to the operation. Commonly, the DMA comprises reinforced concrete or steel and concrete. Any other suitable materials known to a person skilled in the art can also be used.

One aspect of the invention, the DMA assembly comprises a subsea winch. Optionally, the subsea winch is powered by a work class remotely operated vehicle (WROV) hydraulic skid. Conveniently, the DMA is provided with holding means for the guide means of the plug installation device. In one embodiment of the invention, the holding means comprise a container into which the guide means are placed. Preferably, when the guide means comprises guide wires, the guide wires are coiled into the container in a figure of eight formation which allows the guide wires to be deployed from the container without becoming entangled.

In a further embodiment of the invention, the DMA further comprises the buoyancy device, the marine riser tool plug installation device of the invention, the autonomous isolation plug and the securing means.

In a further embodiment of the invention, the marine riser tool of the invention is installable by the work class remotely operated vehicle (WROV).

It is preferable that the marine riser of the BOP has been cut such that the open end of the marine riser is vertical and whereby the distance from the open end of the marine riser to the head of the BOP is equidistant around the circumference of the marine riser.

In another aspect, the present invention also provides a method of sealing a marine riser comprising the following steps:

- the marine riser is cut away (using standard existing technology—a Diamond Wire Cutter mounted on a Work Class ROV or a Wachs Saw™ etc) until a clean cut, round section is provided;
- the clamp is installed near the top of the marine riser;
- subsea guide wires are connected to the clamp;
- the parachute is released and articulates into position in the water column above the marine riser, tensioning the guide wires; and
- the plug installation device travels down the guide wires to the marine riser opening.

The plug installation device is hydraulically driven into the marine riser and its forward ram is distended and its four cardinal front pad rams are extended and hydraulically locked into the marine riser pipe internal wall;

The plug installation device forward ram is then retracted thereby pulling the plug installation device deeper into the marine riser;

The plug installation device rear pad rams are extended and hydraulically locked into the marine riser pipe internal wall;

The plug installation device cardinal front pad rams are retracted from the marine riser pipe wall, and its forward ram is distended;

The cardinal front pad rams are extended and hydraulically locked into the marine riser pipe internal wall again.

This process is repeated a number of times in short incremental steps, until the plug installation device has walked its way into the marine riser approximately 1.2 meters.

Then the plug installation device's telescopic puller arm (also referred to as the master ram) is extended back to the entrance of the leaking marine riser.

The isolation plug then is hydraulically driven down the guide wires and is latched onto the plug installation device's telescopic puller arm by the sprung loaded circumferential latching dog mechanism. The latching occurs as follows:

- the male (ball) mechanism on the front end of the plug, enters the female receiver (socket) on the back end of the plug installation device, which contains sprung loaded dogs, which the male ball mechanism opens. Once the largest diameter of the male ball mechanism is through the dogs, the locking latch of the dogs latches on the flat face at the back of the ball, thereby capturing the male ball mechanism, within the female receiver.

The isolation plug (in by-pass mode) is pulled approximately 1 meter into the flowing marine riser.

The BOP isolation plug is hydraulically set. The isolation plug comprises a hydraulic system which, when the plug is set, is activated to push its grips onto the internal riser pipe wall and its rubber seal (known in the art as a "packer") is squeezed so as to contact and seal on the pipe wall.

When an isolation plug is SET, its hydraulic activation system is energised, meaning fluid is pumped to one side of a piston, which moves the piston, which pushes grip segments out onto the internal riser pipe wall where they grip into the riser pipe wall. They actually bite about 0.03 mm into the pipe wall, plastically deforming the pipe. Once the grips are engaged, they cannot go any further, but by continuing the hydraulic activation of the piston, compress the rubber seal. The packer has nowhere to go when it gets squashed, so it changes its shape, and squishes out to touch the internal riser pipe wall, and makes a seal. After the pass-through valves are shut, the full downstream delta (the pressure of gas and fluid down in the marine riser which is trying to escape) puts its full force onto the pressure head of our plug, which further squeezes the packer, and thereby intensifies the seal provided by the plug known in the art as the intensification of the SET of the plug (packer).

The BOP isolation plug's internal by-passes are isolated (shut).

This method eliminates the requirement to use guide wires from a surface vessel which can risk the safety of the vessel running the guide wires, arising from the vessel being in the gas aeration zone.

The invention will hereinafter be more particularly described with reference to the accompanying drawings which illustrate by way of example only, one embodiment of the marine riser tool of the present invention.

Figure 1A:
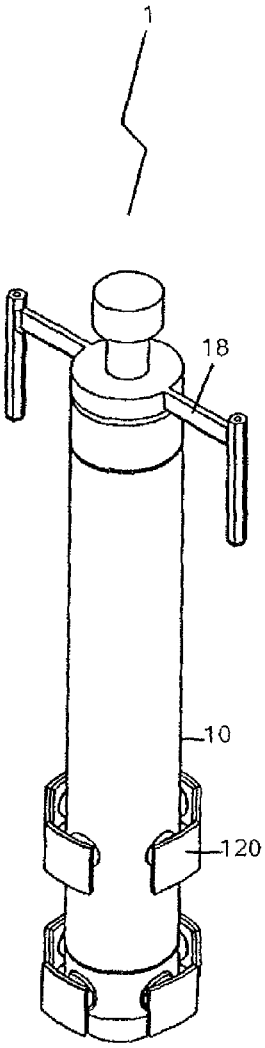
FIG. 1A is a perspective view of the plug installation device of the marine riser tool of the present invention, with the hydraulic rams of the plug installation device shown in a retracted position.
Figure 1B:
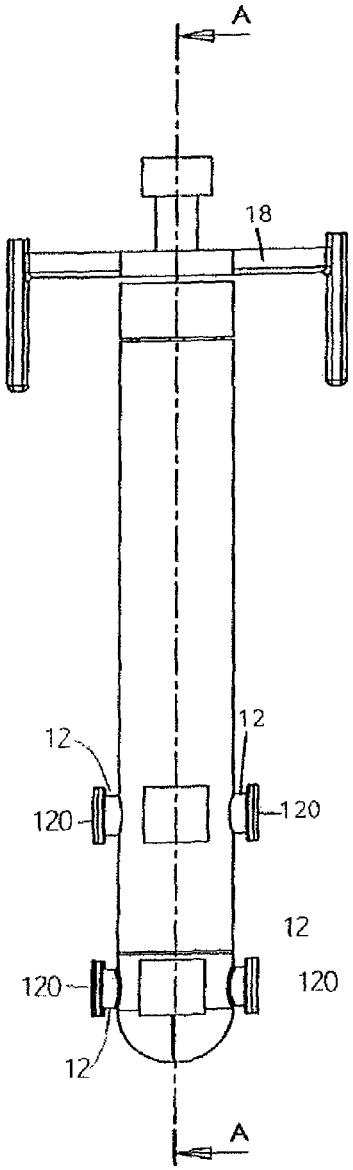
FIG. 1B is a side view of the plug installation device of FIG. 1A.
Figure 1C:
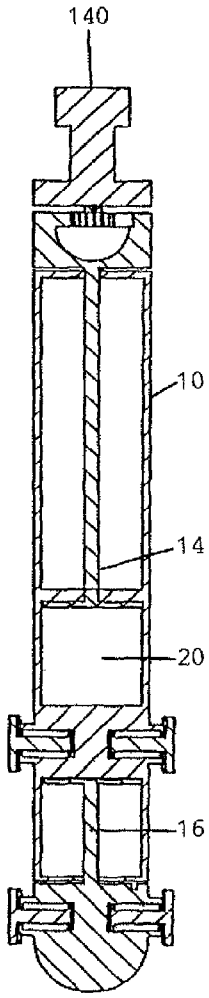
FIG. 1C is a sectional view of the plug installation device of FIG. 1B along the line A-A of FIG. 1B.

Referring initially to FIGS. 1A to 2E, there is shown a marine riser isolation tool comprising a plug installation device 1 comprising a robotic unit 10. The robotic unit 10 comprises a control pod 20 which houses a pair of embedded microprocessors (not shown). The plug installation device 1 also comprises eight hydraulic rams 12 which are axially mounted in two sets of four hydraulic rams 12 and the plug installation device 1 also comprising two further hydraulic rams namely, a master ram 14 and a secondary ram 16, both of which are longitudinally mounted within the body of the plug installation device 1.

The longitudinally mounted rams 14 and 16 are of two different lengths; the master ram 14 having a longer stroke than the secondary ram 16. The maximum extension of the master ram 14 is approximately 1.2 meters while the maximum extension of the secondary ram 16 is approximately 300 mm.

The components contained within the control pod 20 are housed at one atmosphere pressure. The components included within the control pod comprise a CPU (Control Processing Unit), an ELF communications and monitoring system, electric motor, hydraulic pump, hydraulic accumulator, sensors, valving and switching, redundancy structure, and a Lithium Sulphur Dioxide power train.

Each of the eight axially mounted rams 12 is provided with axial compression pads (known as Gekos) 120 which are configured to provide maximum grip of the compression pads 120 under action of the extended axial rams 12, hydraulic rams against the pipeline wall. The compression pads 120 are threaded to achieve the maximum grip possible. In the preferred embodiment of the invention, shown in the diagrams, the axial rams 12 are configured into two sets of four rams, arranged annularly around the plug installation device 1 such that each of the axial compression pads 120 is equidistant from each other in a circular ring arrangement around the plug installation device 1.

Figure 5:
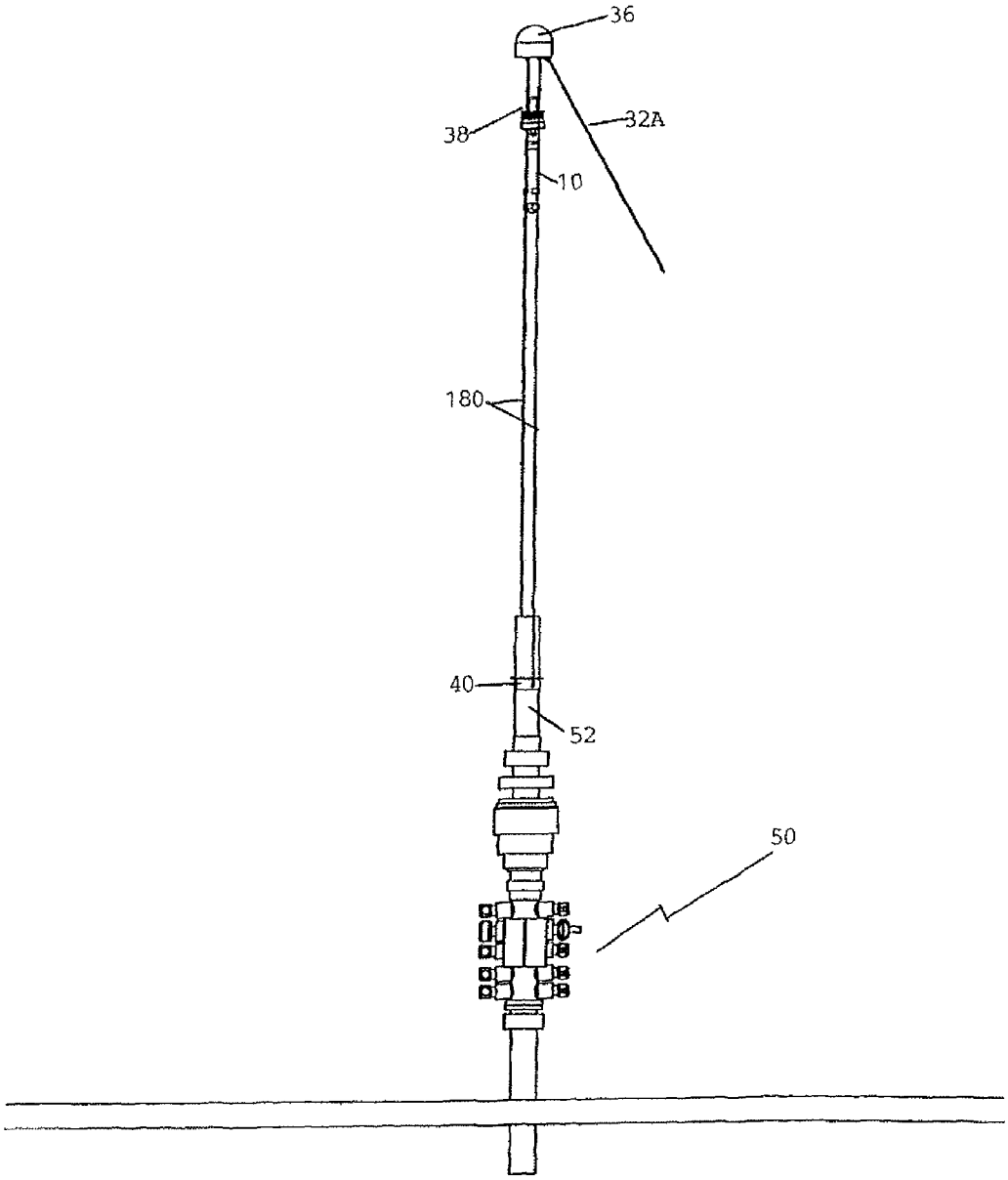
FIG. 5 is a side view of the plug installation device positioned on the guide means attached to the marine riser and to the buoyancy device.
Figure 6:
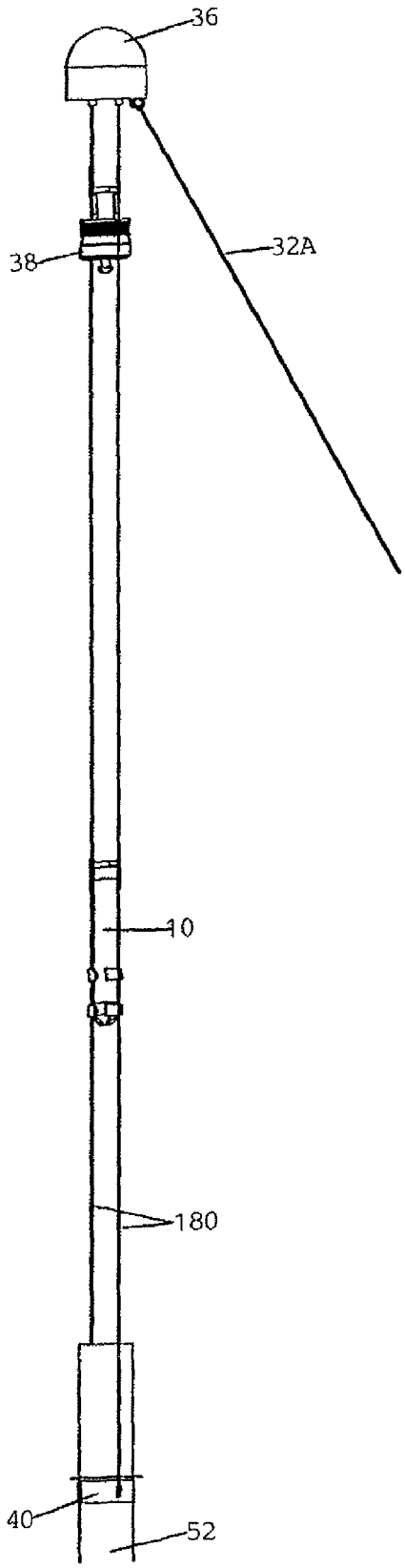
FIG. 6 is an enlarged side view of the plug installation device of FIG. 5 moving down the guide means towards the open marine riser.
Figure 7:
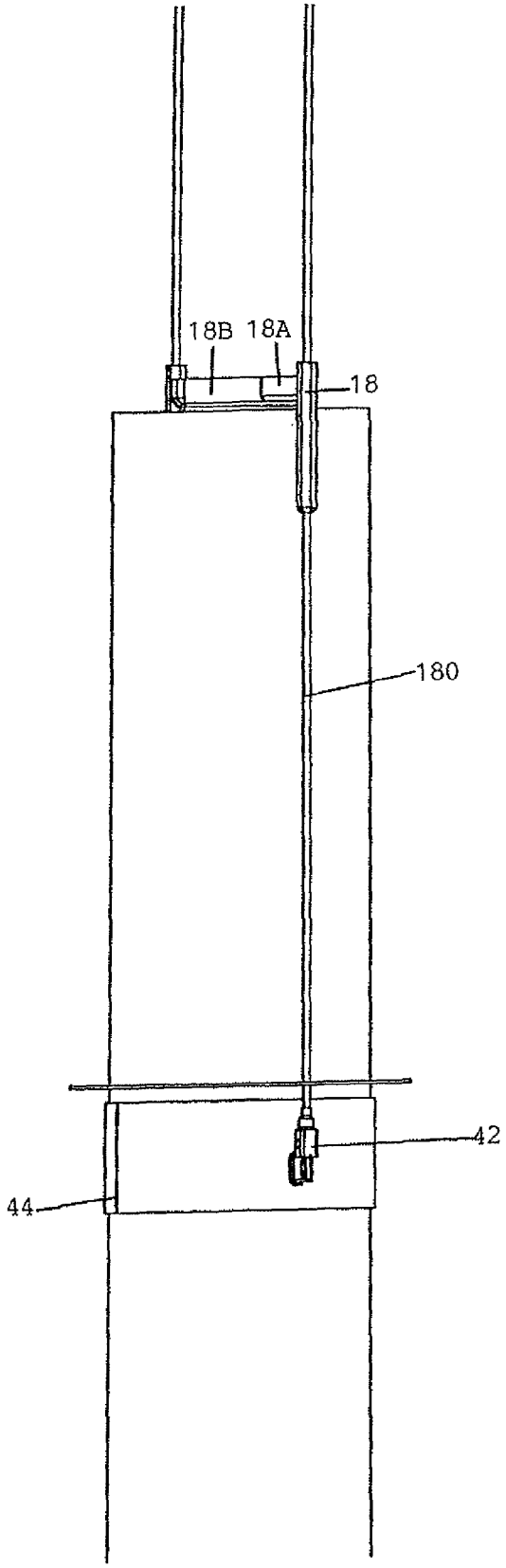
FIG. 7 is an enlarged side view of the open marine riser where the plug installation device has entered the marine riser.

Plug installation device 1 is also provided with integrated hydraulic wire pullers 18, which can both push and pull the installation device 1 along the parallel guide wires 180 (shown in FIG. 5) in a controlled manner. The hydraulic wire pullers 18 provide sufficient force to enable the plug installation device to be pulled, in a controlled manner along the guide wires 180 and then to be pushed into the open top of the marine riser 52 (FIG. 5), even with the force of exiting fluid (liquid/gas opposing its entry). The marine riser 52 connects to the pipeline through a blow-out preventer (BOP) stack 50.

Figure 2A:
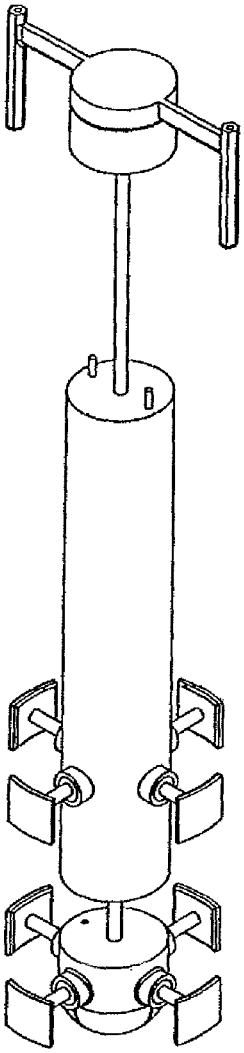
FIG. 2A is a perspective view of the plug installation device with the hydraulic rams shown in an extended position.
Figure 2B:
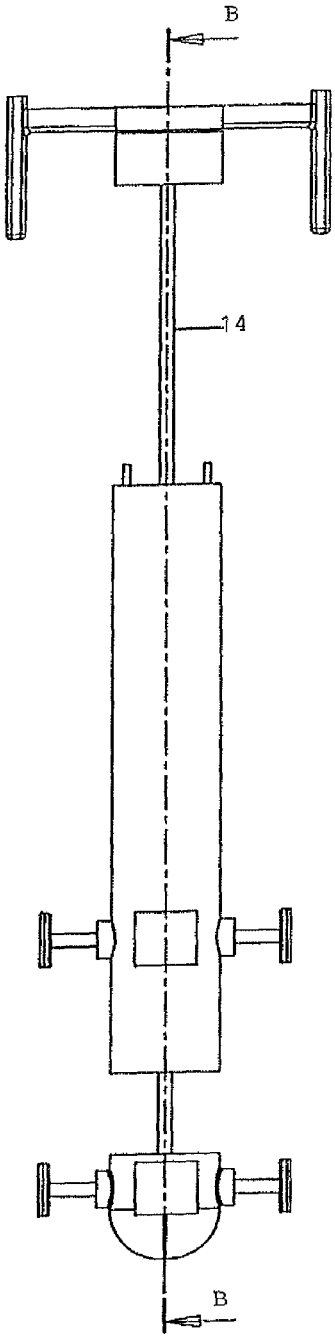
FIG. 2B is a side view of the plug installation device of FIG. 2A.
Figure 2C:
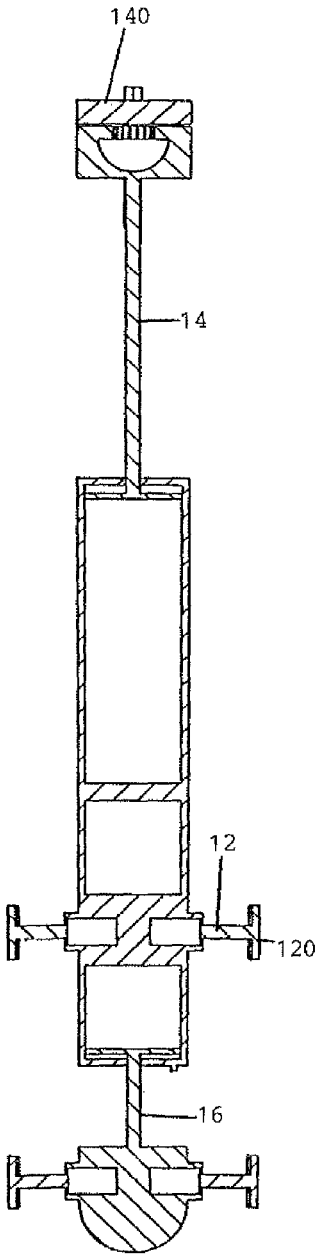
FIG. 2C is a sectional view of the plug installation device; along the line B-B of FIG. 2B.
Figure 2D:
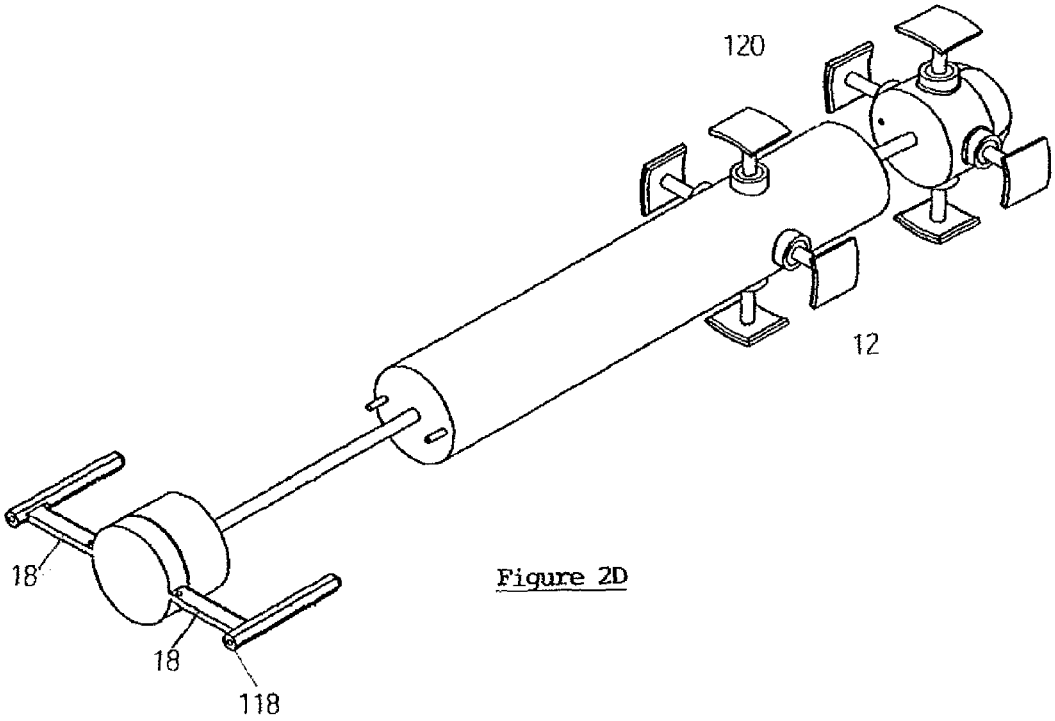
FIG. 2D is a perspective view of the plug installation device of FIG. 2A shown in a horizontal orientation.
Figure 2E:
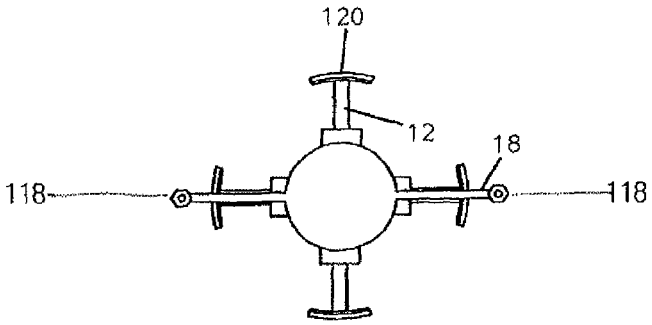
FIG. 2E is an end view of the plug installation device of FIG. 2D.
Figure 3C:
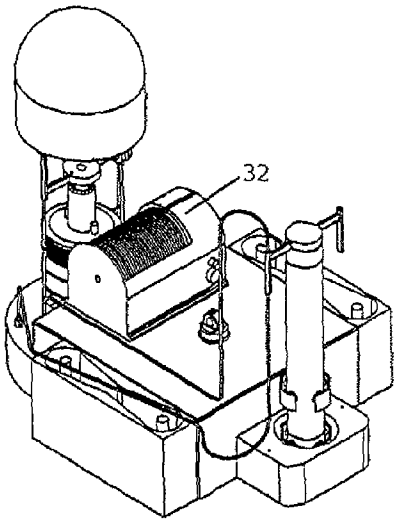
FIG. 3C is a perspective view of the marine riser tool of FIG. 3A.
Figure 3B:
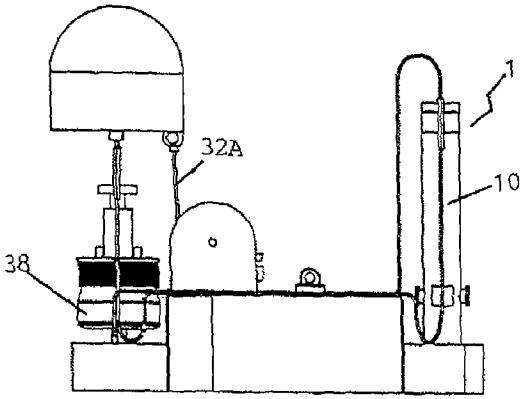
FIG. 3B is a side view of the marine riser tool of the present invention shown in FIG. 3A.
Figure 3D:
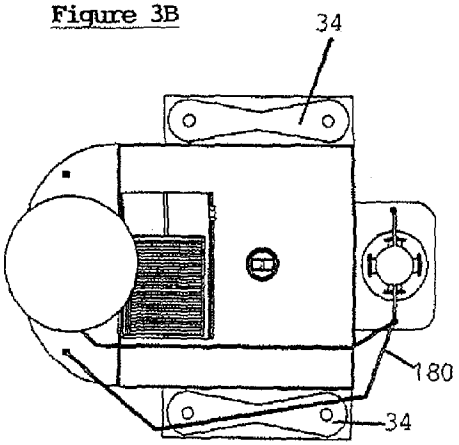
FIG. 3D is a top view of the marine riser tool of FIG. 3A.
Figure 3A:
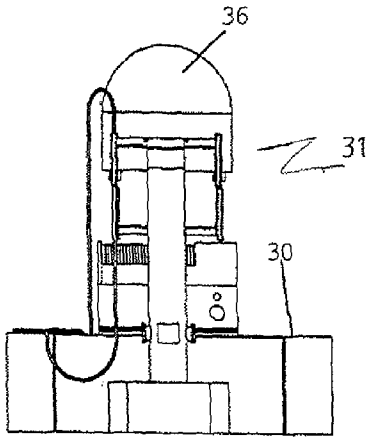
FIG. 3A is an end view of the dead man anchor assembly of the marine riser tool of the present invention including the plug installation device and other elements of the assembly, mounted on a dead man anchor.
Figure 8:
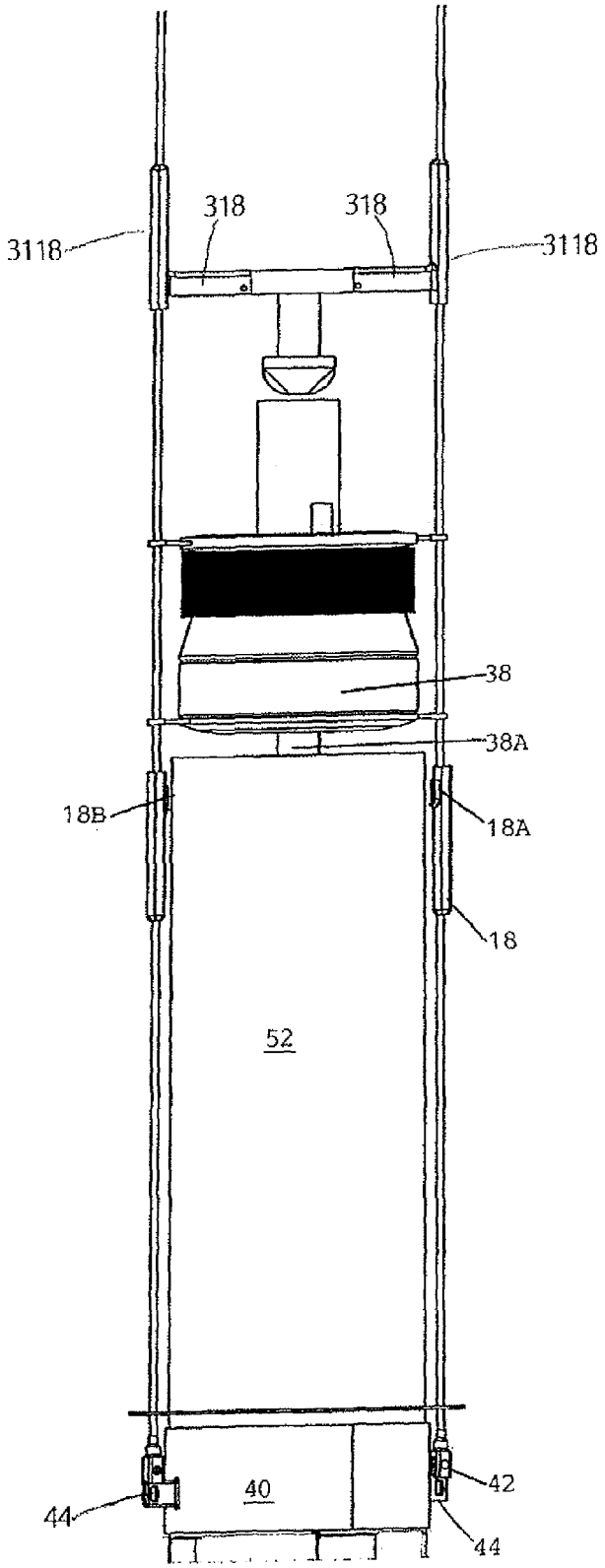
FIG. 8 is an enlarged side view of the open end of the marine riser showing the autonomous plug and plug installation device entering the marine riser.

Referring now to FIGS. 3A to 3D, in one embodiment of the invention, the plug installation device 1 is included in a Dead Man Anchor (DMA) assembly indicated generally by reference numeral 31 to facilitate delivery of an isolation plug 38 and the plug installation device 1 into the open marine riser 52. The DMA assembly includes a DMA 30. The DMA 30 is a 5 ton cubic anchor made from steel and concrete. It is used to anchor the various components of the marine riser isolation tool, included on the Dead Man Anchor assembly 31 at the required position on the seabed. The dead man anchor (DMA) assembly also includes a Syntactic Foam Parachute 36, and the isolation plug 38. Furthermore, the DMA assembly 31 includes a clamp (not shown), or the clamp may be deployed separately (not shown in FIG. 3A to 3D but is shown by reference numeral 40 in other Figures). (For clarity, the clamp is not shown in these drawings.) The DMA assembly 31 also includes a subsea winch 32, which is powered by a WROV hydraulic skid. The DMA assembly 31 also includes two baskets 34, each of which baskets 34 houses a guide wire 180. The baskets 34 are profiled such that the guide wires 180 are stored in a figure of eight formation, (this formation is not shown in FIG. 3D for clarity reasons) to ensure that they deploy without twisting. The plug installation device 1 and the isolation plug both have guides (the integrated hydraulic wire pullers 18), and these are pre threaded onto the guide wires 180. With reference to FIGS. 2D and 2E, each of the wire pullers 18 includes a guide wire receiving sleeve 118 through which the guide wire is threaded. A corresponding arrangement is provided on the isolation plug 38 which also includes wire pullers 318 and a guide wire receiving sleeve 3118 (shown in FIG. 8) The guide wires 180 terminate at their upper end, at the parachute 36, and at their lower end at the connectors which are coupled onto the clamp, which is installed onto the marine riser. The guide wires are flaked down in a figure of 8 arrangement in the guide wire baskets.

The plug installation device 1 and the isolation plug 38 are mounted on the guide wires 180. The clamp securing means comprises a two half shell-closing bracelet clamp 40 which will be installed around the marine riser to provide an anchor point for the two guide wires 180. It is made from titanium (for lightness of handling by the ROY and high strength to weight ratio). It also has a serrated internal surface (grips) configured to bite into the marine riser pipe wall and hold against the direction of pull by the guide wires. It also had two pad eyes 44 mounted on its outside at 3 o'clock and 9 o'clock, to which the guide wires will be attached by the WROV. The clamp can be deployed subsea on board the DMA assembly, in the sprung open condition. After the ROV positions it on the marine riser it is hydraulically locked in place by energising of the clamp's hydraulic cylinder using the WROV hydraulics. Then two additional back up bolts are closed on the damp, and tensioned to guarantee the clamp 40 will stay securely locked onto the marine riser, throughout the operation.

Referring now to the remaining figures of the drawings, in the event of any failure of a BOP, the following procedure is followed to isolate effectively, the marine riser.

The marine riser is cut away using standard existing technology, for example, a diamond wire cutter mounted on a W ROV (Work Class Remotely Operated Vehicle) or a Wachs Saw™ until a square cut round section is provided, i.e. until the open end of the marine riser is clean cut, in horizontal plane, across the mouth whereby the distance from the open end of the marine riser to the head of the BOP is equidistant at all points on the circumference of the marine riser. The obstructing marine riser section is then pulled/lifted/moved away by crane, winch or by further multiple cuts, to give a clear work area.

The DMA assembly 31 is lowered onto the sea bed, into a position approximately 30 meters diagonally away from the cut marine riser. The clamp 40 to be installed on the marine riser 52 is removed from the DMA assembly 31 and is carried by the WROV to a point on the marine riser 52 which is approximately 1.5 meters below the cut. The clamp 40 is installed on the marine riser 52, hydraulically closed, and mechanically locked and the tension bolts are torqued up. The installed clamp 40 will now function as the anchor point on the marine riser 52 for the guide wires 180.

Each of the guide wires 180 is released from its respective basket 34 included on the sides of the DMA assembly 31. Each guide wire 180 lower end is flown to the clamp 40 by the WROV (Work Class Remotely Operated Vehicle) and is connected to the pad eyes 44 on the clamp using connecting means 42 on the end of each guide wire 180. The connection means 42 can be any type of connection means known to a person skilled in the art. There are many different types of connector, including collet connector, stab connector, clamp, WROV shackle connectors, etc. A stab connector is preferably used, with the stab connector resisting against a sprung collet. Although not shown in the drawings, the syntactic foam parachute 36 also comprises an integral frame spreader bar to which the opposite ends of the guide wires 180 from those connected to the clamp 40 are connected.

Figure 4A:
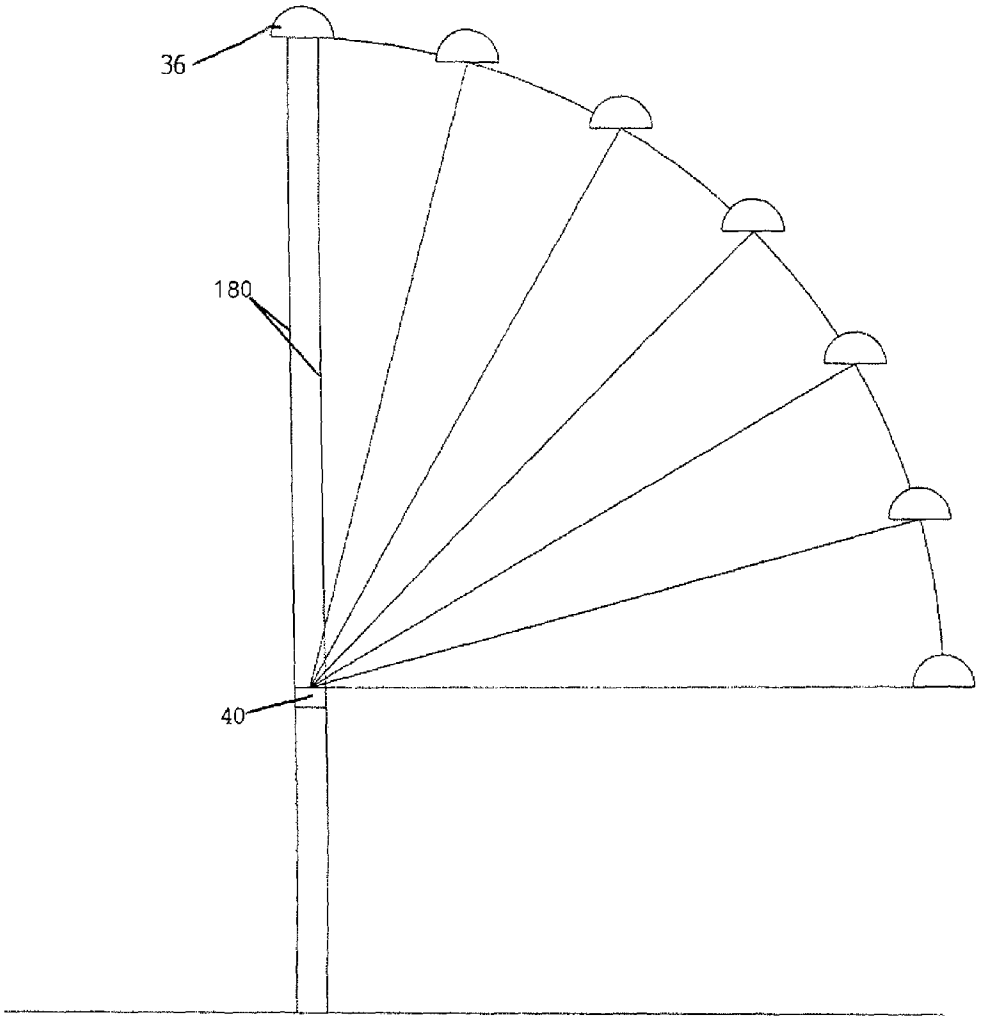
FIG. 4A is a graphical representation of the trajectory path of the buoyancy device of the marine riser tool as the buoyancy device moves from a rest position into an operational position above an open marine riser.
Figure 4B:
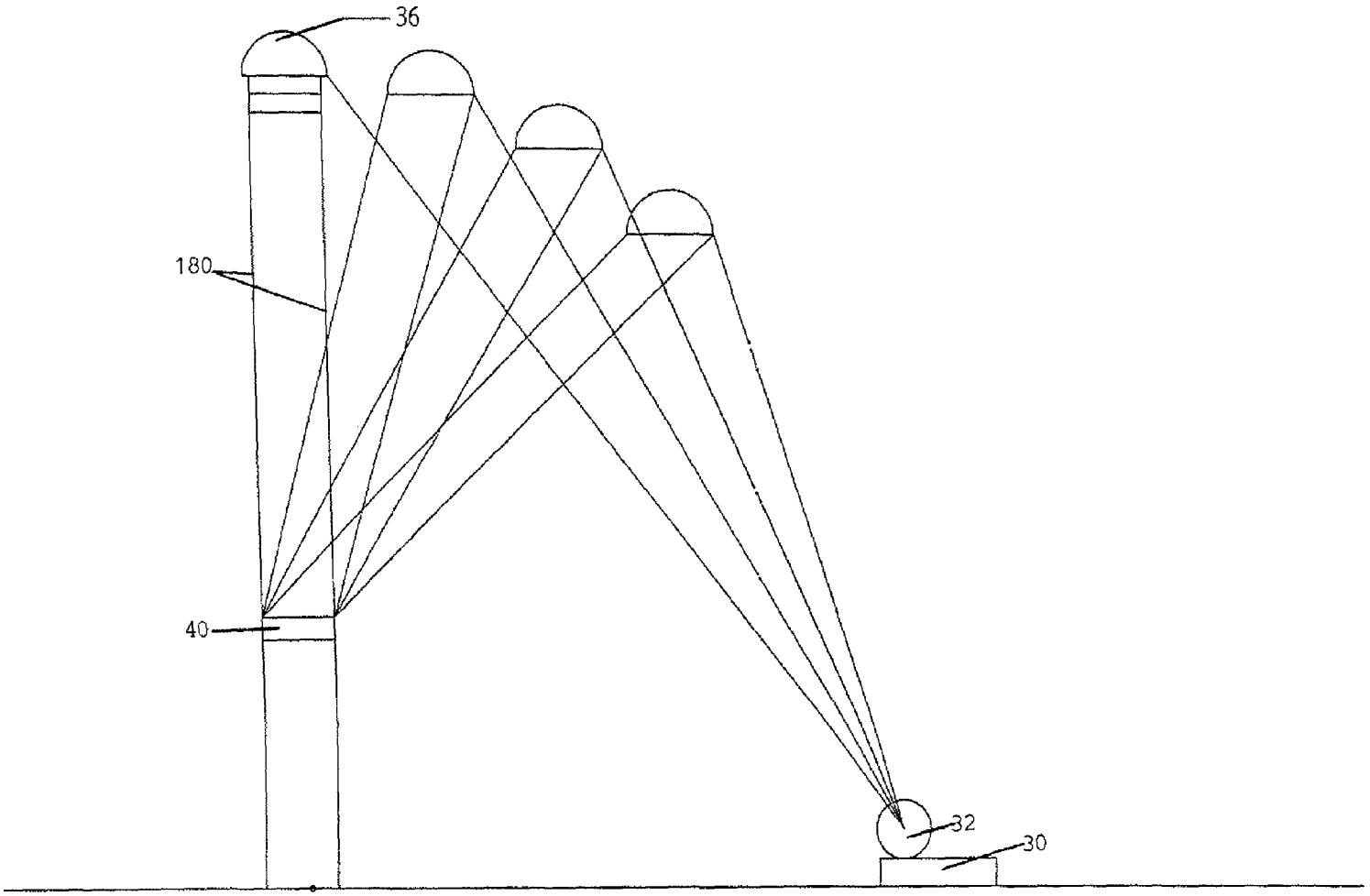
FIG. 4B is a graphical representation image of the trajectory path of the guide means and buoyancy device as it moves off centre above the open marine riser when connected to the dead man anchor.

The WROV then provides hydraulics to the DMA subsea winch 32. The DMA subsea winch 32 is operated so as to release the syntactic foam parachute 36 winch wire 32A which in turn releases the syntactic foam parachute 36. The syntactic foam parachute 36 is released until the guide wires 180 are extended to their limit which point, the parachute 36 is in vertical position as shown in FIG. 4A. The syntactic foam parachute 36 follows a trajectory resembling a 90 degree arc in the water column, as it reaches the full extent of the two guide wires 180 and the controlling DMA winch wire 32A as shown in FIG. 4B. At this point, the syntactic foam parachute 36 is positioned (plumbed vertically) in the water column, the length of the guide wires approximately 30 meters) vertically above the top of the cut off marine riser 52. The plug installation device 1 and isolation plug 38 were pre-mounted on the guide wires 180 when in position on the DMA 30, thus the plug installation device 1 and the isolation plug 38 are now also positioned above the cut off marine riser 52.

The plug installation device 1 is driven down the guide wires 180 by the integrated hydraulic wire pullers 18 to the marine riser 52. This activity is controlled by the WROV communicating with the wire pullers 18 using ELF cOmmunications. The hydraulic wire pullers 18 operate in either direction, i.e. either down along the guide wires or up along the guide wires ensuring that it is easy to reverse the position of the plug installation device 1 when and if necessary. The plug installation device 1 is then driven into the cut off marine riser pipe 52 by the integrated hydraulic wire pullers 18. As the body of the plug installation device 1 is brought within the cut off marine riser pipe 52, the plug installation device 1 begins to engage the axially mounted rams 12 against the marine riser wall. The plug installation device 1 can enter the flow path of the fluid flowing in the marine riser since the plug installation device 1 has a low surface area profile relative to the opening of the cut off marine riser 52. Furthermore, the integrated hydraulic wire pullers 18 provide the plug installation device 1 with a combined force of over 222 kN which ensure that the tool can be pushed into the marine riser 52 against the pressurised fluid pouring out of the marine riser 52. Although not shown, it is also possible to offset the syntactic foam parachute 36 from the vertical by the tensioning the DMA controlling winch wire 32A to keep the syntactic foam parachute 36 tilted away from the rising column of fluid or gas emanating from the marine riser 52 when moving the plug installation device 1 into position.

When the plug installation device 1 enters the cut off marine riser 52 the secondary ram 16 is distended. The first group of four axially mounted cardinal front pad rams 12 are then extended and hydraulically locked into the marine riser internal wall. The secondary ram 16 is then retracted pulling the plug installation device 1 deeper into the marine riser 52. The second group of four axially mounted cardinal rear pad rams 12 are extended and hydraulically locked onto the marine riser pipe internal wall. The first group of four axially mounted cardinal front pad rams 12 are then retracted from the marine riser internal wall and the secondary ram 16 is again distended. The first group of four axially mounted cardinal front pad rams 12 are again extended and hydraulically locked into the marine riser internal wall. The second group of four axially mounted cardinal rear pad rams 12 are retracted. The secondary forward ram 16 is again retracted, pulling the plug installation device 1 yet deeper into the marine riser 52. This process is repeated a number of times such that the plug installation device 1 moves into a marine riser in short incremental steps, until the plug installation device 1 has "walked" approximately 1.2 meters into the marine riser 52. All of the axially mounted cardinal front and rear pad rams 12 are extended and hydraulically locked onto the marine riser internal wall. The master ram 14 which includes a female collet connector 140 (FIG. 2C) mounted thereon, is then extended back to the entrance of the leaking marine riser pipe 52.

The integrated hydraulic wire pullers 18 on the guide wires 180 disengage from the plug installation device 1 when the master ram 14 is fully extended. This is controlled by ELF signals from the WROV which activate the disconnect system. The mechanism to enable the disengaging of the hydraulic wire pullers 18 from the plug installation device 1 is simple valving which splits the pusher mechanism of the hydraulic wire pullers, and enables a spring system to move the pusher mechanism on the hydraulic wire pusher clear. The hydraulic wire pullers can be disengaged by ELF signal from the WROV, which will trip a solenoid to open and spring them free, or it could be by contact trip switch when the wire pullers reach the entrance to the top of the marine riser. The integrated hydraulic wire pullers 18 separate from each other but stay connected to the guide wires 180. This ensures that the hydraulic wire pullers 18 spring clear of the entrance path to the marine riser 52 so as to allow the isolation plug 38 a clear pathway into the marine riser 52.

The by-pass isolation plug 38 is released by ELF signal and it propels itself in a controlled manner down the guide wires 180 using the integrated hydraulic wire pullers 18 where its male stab 38A enters and latches to the female collet connector 140 on the back of the plug installation device 1 thereby locking the isolation plug 38 to the plug installation device 1. The by-pass isolation plug 38 is provided with 75 mm valves which allow pressure or fluid through the plug body. The isolation plug 38 is pulled into the marine riser 52 by retracting the master 14 of the plug installation device. The integrated hydraulic wire pullers 18 also provide additional hydraulic pushing means to ensure the isolation plug 38 can overcome the force of the fluid pouring from the marine riser and make its way into the top of the marine riser 52. This (in context) means that the isolation plug 38 is pulled into the marine riser 52 by retracting the master ram 14 of the plug installation device. The integrated hydraulic wire pullers 18 also provide additional pushing means (this is the 2×12.5 tons of hydraulic force the two hydraulic wire pullers exert, to push the isolation plug 38 into the marine riser. Once the isolation plug 38 has been pulled/pushed the correct distance (approx 1 meter), down into the marine riser 52. The gripping means of the isolation plug 38 are hydraulically set and the packer is sealed. Once the isolation plug has been set and sealed, the pass through valves are closed. This causes the downstream delta to increase on the isolation plug 38 and intensifies the set and the seal of the isolation plug packer. The release of hydrocarbons from the well is now stopped and the turbulent flow from the well is eliminated.

The pass through valves can be operated and manipulated as required by WROV to introduce hoses with the necessary pressurised fluids, muds and cements to control and seal the well bore below the isolation plug 38. When the well is sealed, the isolation plug 38 and plug installation device 1 can be removed from the well-head or replaced as necessary.

The plug must be of appropriate size to suit the marine riser internal diameter (ID) and suitably sized plugs can be provided. The guide wire sizes are consistent irrespective of the size of the marine riser and so also are the integrated hydraulic wire pullers, which can accommodate two different sizes of wire.

It is to be understood that the present invention including the procedure could be used to isolate any vertical pipe marine riser, stand pipe or riser pipe which has pressurised fluid leaking from it.

It will of course be understood that the invention is not limited to the specific details described herein which are given by way of example only and that various modifications and alterations are possible without departing from the scope of the invention as defined in the appended claims.

The invention claimed is:

1. A marine riser isolation tool comprising an autonomous plug installation device that is adapted for locating an autonomous pipeline isolation tool in an opening of a marine riser pipe connected to a well, the autonomous plug installation device comprising:

a hydraulic ram system comprising a plurality of pipeline engaging means positioned along an exterior surface of the hydraulic ram system, the pipeline engaging means being operable by the hydraulic ram system to be movable between a retracted and extended configuration such that the pipeline engaging means are engagable with an interior surface of the marine riser pipe;

a longitudinally mounted telescopic master;

a secondary ram that extends and retracts to move the plug installation device in the marine pipe riser; and a control system in communication with the hydraulic ram system to control the movement of the pipeline engaging means such that the plug installation device locates the pipeline isolation tool at a predetermined location in the marine riser pipe; and a communications system characterised in that the marine riser isolation tool further comprises a guide means, the autonomous pipeline isolation tool and autonomous plug installation device being removably mountable onto the guide means;

the guide means further comprising securing means for securing the guide means to the marine riser pipe; and a buoyancy device whereby the buoyancy device is positioned at one end of the guide means and the securing means are attached to another end of the guide means remote from the buoyancy device.

2. A marine riser isolation tool as claimed in claim 1 further comprising the autonomous pipeline isolation tool for locating in the marine riser.

3. A marine riser isolation tool as claimed in claim 2, wherein the autonomous pipeline isolation tool includes at least one valve which is moveable between an open position and a closed position such that flow of fluid moving upwardly in the marine riser can pass through the valve and hence through the isolation plug when the valve is in the open position but when the valve is in the closed position, no fluid can pass through the plug and the isolation plug seals the marine riser, preventing escape of fluid from the marine riser.

4. A marine riser isolation tool as claimed in claim 1, wherein the plug installation device further comprises a plurality of hydraulic rams, axially mounted thereon.

5. A marine riser isolation tool as claimed in claim 4, wherein the axially mounted rams are arranged in two clusters of four hydraulic rams.

6. A marine riser isolation tool as claimed in claim 5, wherein the two clusters of four axially mounted hydraulic rams are arranged annularly around the plug installation device at opposing ends of the at least one longitudinally mounted ram.

7. A marine riser isolation tool as claimed in claim 4, wherein the autonomous plug installation device comprising a plurality of rams axially mounted thereon is provided with six degrees of freedom namely up, down, left, right, forwards and backwards.

8. A marine riser isolation tool as claimed in claim 1, wherein the securing means securely attach the guide means to the marine riser, at or near the opening of the marine riser.

9. A marine riser isolation tool as claimed in claim 8, wherein the guide means further comprise, guide wires, guide wire pullers and receiving sleeves for mounting the autonomous plug installation device and pipeline installation tool on the guide means.

10. A marine riser isolation tool as claimed in claim 1, wherein the buoyancy device provides a positive up-thrust of buoyancy and is held in position above the opening of the marine riser pipe at a distance determined by the guide means, whereby the buoyancy device allows the marine riser isolation tool comprising the plug installation device and/or pipeline isolation tool to be positioned above the opening of the marine riser pipe.

11. A marine riser isolation tool as claimed in claim 1, wherein the buoyancy device comprises a syntactic foam parachute or other buoyancy means.

12. A marine riser isolation tool as claimed in claim 1, wherein the guide means comprises subsea guide wires.

13. A marine riser isolation tool as claimed in claim 1, comprising an anchor for anchoring the marine riser tool on a seabed near to a location of a marine riser needing to be sealed.

14. A marine riser isolation tool as claimed in claim 1, wherein the communications system is an Extremely Low Frequency (ELF) communications system.

15. A method of sealing a marine riser pipe using a marine riser isolation tool as claimed in claim 1, the method of sealing the marine riser comprising the following steps:

(a) cutting the marine riser pipe such that a clean cut section is provided at the opening of the marine riser pipe;

(b) connecting the securing means at or near the opening of the marine riser pipe;

(c) connecting the guide means to the securing means;

(d) releasing the buoyancy device thereby tensioning the guide means above the opening of the marine riser pipe;

(e) moving the plug installation device along the guide to the opening of the marine riser pipe and into the marine riser pipe;

(f) activating the hydraulic ram system of the plug installation device to locate a pipeline isolation tool at a predetermined location within the marine riser pipe; and (g) hydraulically setting the autonomous pipeline isolation tool to seal the marine riser pipe.

16. A method of sealing a marine riser pipe using a marine riser isolation tool as claimed in claim 4, the method of sealing the marine riser comprising the following steps:

(a) cutting the marine riser pipe such that a clean cut section is provided at the opening of the marine riser pipe;

(b) connecting the securing means at or near the opening of the marine riser pipe;

(c) connecting the guide means to the securing means;

(d) releasing the buoyancy device thereby tensioning the guide means above the opening of the marine riser pipe;

(e) moving the plug installation device along the guide to the opening of the marine riser pipe and into the marine riser pipe;

(f) activating the hydraulic ram system of the plug installation device to locate a pipeline isolation tool at a predetermined location within the marine riser pipe by;

(i) the control system of the plug installation device communicating with the hydraulic ram system such that when the plug installation device enters the marine riser the longitudinally mounted ram is distended and the first cluster of four hydraulic rams are extended and hydraulically locked into an internal wall of the marine riser pipe;

(ii) the plug installation device longitudinally mounted ram is then retracted thereby pulling the plug installation device deeper into the marine riser pipe;

(iii) the plug installation device second cluster of four hydraulic rams are extended and hydraulically locked into the marine riser pipe internal wall;

(iv) the plug installation device first cluster of four hydraulic rams are retracted from the marine riser pipe internal wall, and the longitudinally mounted ram is distended;

(v) the first cluster of four hydraulic rams are extended and hydraulically locked into the marine riser pipe internal wall again;

(vi) steps (i) to (v) repeated a number of times in short incremental steps, until the plug installation device has been located within the marine riser pipe;

(vii) the pipeline isolation tool then travels down the guide wires and is latched onto the plug installation device's telescopic master ram;

(viii) the master ram is extended back to the opening of the marine riser pipe;

(ix) the pipeline isolation tool isolation plug (in by-pass mode) is pulled into the marine riser pipe; and (x) the pipeline isolation tool is hydraulically set; and (g) hydraulically setting the autonomous pipeline isolation tool to seal the marine riser pipe.

* * * * *